US005341557A

United States Patent [19]

Perlman

[11] Patent Number: 5,341,557

[45] Date of Patent: Aug. 30, 1994

[54] USE OF NON-ADHESIVE STRETCH-FILM AS A LABORATORY CONTAINER CLOSURE

[75] Inventor: Daniel Perlman, Arlington, Mass.

[73] Assignee: Brandeis University, Waltham, Mass.

[21] Appl. No.: 975,404

[22] Filed: Nov. 12, 1992

[51] Int. Cl.[5] ..... B23P 11/00

[52] U.S. Cl. ..... 29/446; 29/448; 53/441

[58] Field of Search ..... 29/446, 448, 449, 450; 53/441; 428/35.7

[56] References Cited

U.S. PATENT DOCUMENTS

| | | | |
|---|---|---|---|
| 2,500,549 | 3/1950 | Ketay et al. . | |
| 2,631,954 | 3/1953 | Bright . | |
| 3,547,305 | 12/1970 | Khoury . | |
| 4,073,782 | 2/1978 | Kishi et al. . | |
| 4,082,877 | 4/1978 | Shadle . | |
| 4,199,917 | 4/1980 | Mitchell | 53/441 |
| 4,337,188 | 6/1982 | Climenhage et al. . | |
| 4,379,197 | 4/1983 | Cipriani et al. . | |
| 4,399,180 | 8/1983 | Briggs et al. . | |
| 4,418,114 | 11/1983 | Briggs et al. . | |
| 4,425,268 | 1/1984 | Cooper . | |
| 4,436,788 | 3/1984 | Cooper . | |
| 4,504,434 | 3/1985 | Cooper . | |
| 4,592,960 | 6/1986 | Inoue et al. | 428/461 |
| 4,619,859 | 10/1986 | Yoshimura et al. . | |
| 4,657,982 | 4/1987 | Breck et al. . | |
| 4,658,568 | 4/1987 | Reid et al. | 53/441 X |
| 4,671,987 | 6/1987 | Knott, II et al. . | |
| 4,713,282 | 12/1987 | Yazaki et al. . | |
| 4,833,017 | 5/1989 | Benoit . | |
| 5,006,398 | 4/1991 | Banerji | 428/516 X |
| 5,171,593 | 12/1992 | Doyle | 53/441 X |
| 5,176,953 | 1/1993 | Jacoby et al. | 428/315.5 |

FOREIGN PATENT DOCUMENTS

| | | | |
|---|---|---|---|
| 203431 | 6/1955 | Australia | 427/208.4 |

*Primary Examiner*—Timothy V. Eley
*Attorney, Agent, or Firm*—Lyon & Lyon

[57] ABSTRACT

A method for covering and sealing an opening in a container. The method employs a polyolefin-based stretch film which is free of adhesive and has a softening temperature in excess of 100° C. At least one surface of the film having an upper and lower surface is substantially free of constituents which can dissolve in, or react with an organic solvent or a caustic agent. The method includes the steps of:

(i) providing a portion of the film which covers the container opening, (ii) stretching the film using a mechanical force in a direction generally parallel to the principal axis of the container opening, and (iii) releasing the force and allowing the film to contract around the container opening to provide a liquid-tight seal over the opening.

12 Claims, No Drawings

USE OF NON-ADHESIVE STRETCH-FILM AS A LABORATORY CONTAINER CLOSURE

BACKGROUND OF THE INVENTION

This invention concerns a method of forming a liquid-tight closure over a container opening employing a non-adhesive stretch film, and the uses of such a closure in the laboratory.

A stretchable self-sealing plastic wrap has been used for many years in the chemical laboratory to provide a convenient water-tight closure on a test tube or other container. This stretch wrap known as PARAFILM® is manufactured by the American National Can Corporation and is described in the manufacturer's brochure titled "Parafilm M, the all purpose laboratory film and dispenser". The film, containing a substantial proportion of a cohesive paraffin wax, is permanently self-adherent when stretched over and around an object or a container opening. Irreversible elongation and thinning of PARAFILM® occurs during the stretch wrapping process. PARAFILM® is susceptible to most common organic solvents, and has a low softening temperature (approximately 60° C.), well below that of boiling water.

Another adhesive wrap is described by Ketay et al., U.S. Pat. No. 2,500,549 in which a cellulose acetate film is partially coated on one side with a pressure-sensitive adhesive. The film is used to fit tightly over a container opening, attach to the container by the adhesive, and later be detachable from the container.

Non-adhesive stretch-wrap films which are composed of one or more thermoplastic layers and which include the polyethylene-based cling-type stretch wraps, are also known. Kishi et al., U.S. Pat. No. 4,073,782, describe a wrapping film containing either polyethylene or a copolymer of vinyl acetate and ethylene (or a mixture of these), plus sorbitan monooleate and liquid paraffin. The monooleate serves as an antihazing agent, while the viscosity and quantity of paraffin oil are selected to control the film cling.

Shadle, U.S. Pat. No. 4,082,877, describes a composite laminar film containing an elastomeric layer and a sealable layer of a polymeric composition containing an interpolymer of ethylene and alkenoic acid.

Climenhage et al., U.S. Pat. No. 4,337,188, describe a polyolefin composition for manufacture of a film having cling properties. The mixed composition includes a polyethylene blend, an elastomer copolymer including ethylene and propylene, and an agent selected from a class of organic compounds (certain organic liquids or waxy solids such as mineral oil and liquid polyolefin).

Cipriani et al., U.S. Pat. No. 4,379,197, describe a stretch wrapping film consisting of linear low density polyethylene (LLDPE) and sorbitan monooleate. The LLDPE is said to provide strength and toughness to the film while the monooleate provides the appropriate degree of cling.

Briggs et al., U.S. Pat. No. 4,399,180, describe a triple-layered coextruded polyolefin stretch wrap having a relatively thick core layer of linear low density polyethylene co-polymers, such as ethylene co-polymerized with at least one $C_4$ to $C_{10}$ alpha-olefin, and one or two relatively thin skin layers of highly branched low density polyethylene. The resulting multilaminate structure is said to have a reduced tendency to tear compared to other films.

Cooper, U.S. Pat. Nos. 4,425,268 and 4,456,788, describes a composition for stretch wrap film including a high molecular weight copolymer of ethylene and vinyl acetate, a linear copolymer of ethylene and higher alkene, and a tackifier to impart cling. Cooper also describes a multilayer composite stretch film composition including a first layer of a high molecular weight ethylene and vinyl acetate copolymer and a tackifier. A second layer which is adhered to the first, is principally linear low density polyethylene.

Breck, U.S. Pat. No. 4,657,982, describes polymer blends and films including up to 99% of a linear copolymer of ethylene and $C_4$ to $C_8$ $\alpha$-olefin or a mixture of this linear copolymer and high density polyethylene or ethylene-vinyl acetate copolymer, and 0.5% -10% each of low molecular weight and higher molecular weight polybutene. The mixture of polybutenes is said to impart higher cling strength than that achieved with single polybutenes.

Knott, U.S. Pat. No. 4,671,987, describes a thin printable multilaminate stretch wrap which exhibits strong cling. The film includes at least two layers, one layer containing a blend of ethylene-vinyl acetate (EVA) copolymer and a tackifier, and a second layer free of tackifier (thereby allowing printing), including at least 50% linear very low density polyethylene (VLDPE). The film may also include a layer of LLDPE positioned between the tackified EVA layer and the VLDPE layer of the film.

Benoit, U.S. Pat. No. 4,833,017 describes a thermoplastic stretch wrap film fabricated from a polyolefin such as LLDPE in which one surface of the film possesses cling and the opposite surface, lacking cling, possesses a slide property obtained by bonding a particulate antiblock agent to the surface. The film is used for conventional unitized packaging of articles.

Japanese Patent 53,034,845, describes the use of chlorinated paraffin as a tackifier in an ethylene-vinyl acetate self-adhesive stretch film.

SUMMARY OF THE INVENTION

This invention relates to the laboratory use of a non-adhesive polyolefin-based stretch film to form liquid-tight container closures. The film, which is insoluble in common organic solvents, and resistant to a temperature of 100° C., is designed to function as a removable protective covering and sealing film for bottles, test tubes, flasks, beakers and the like. Use of this film is advantageous over existing laboratory stretch film (PARAFILM®) and "kitchen wraps", including polyethylene and polyvinylidene (SARAN) films used for covering containers.

In the field of commercial packaging, a large number of single and multilayer thermoplastic stretch-wrap films have been developed for over-wrap packaging of goods, particularly for wrapping pallet loads, and the stretch-packaging of foodstuffs. Physical properties which are usually sought in such films include strength, stretchability, optical clarity and cling. The property of cling is functionally defined as the tendency of a film to bind to itself without the use of a surface adhesive, or heat treatment following contact between two surfaces of the film. Generally cling films are not sticky to the touch and do not adhere to metal, wood and many other foreign materials. Cling, which is a reversible and weak friction-like attachment, and is quantified as the force (in grams per centimeter of film width) required to pull apart a pair of strips of the film in a shearing mode (antiparallel pulling on the opposite ends of the paired strips) after the strips have been placed in face to face contact with 2.54 cm (one inch) of their lengths overlapping. Generally, existing cling stretch wrap peels and unrolls readily, having been engineered to exhibit a maximum of cling with little or no adhesive strength perpendicular to the film. The latter type of adhesion is thought to be undesirable since it would prevent storage of the film in roll form and cause adjacent stretch-wrapped packages in storage to adhere together and become damaged. If permanent self-adhesion of a stretch-wrap is desired (such as sealing a pallet wrap to itself), the film is generally cut and attached to the previous layer of film using heat-sealing, tape or surface-adhesive application. The latter adhesive bonding of surfaces, whether of a permanent or a removable nature, may be quantified by the adhesive "peel strength", i.e., the force (in grams per centimeter of film width) required to pull apart the adjacent ends of a pair of adhered strips of film in a peeling mode (180° bending over of one strip followed by pulling the strips in opposite directions).

In co-pending patent application Ser. No. 07/741,125, Applicant has described the addition of a pressure-sensitive adhesive agent to stretch films to provide sealing films useful for securely and yet reversibly sealing laboratory containers and the like. Using one strategy, solvent resistant adhesives are blended with polyethylene and rubber to form a single layer blended film. Using a second strategy, adhesives are externally applied to polyolefin stretch films used in commercial packaging, e.g., polyethylene stretch films used for pallet wrapping.

Applicant has now discovered that in the absence of either a blended or externally applied adhesive, a polyethylene-based rubberized stretch film (for example, a highly stretchable pallet wrap having cling) has the remarkable ability to form a liquid-tight and secure stable container seal if the film is appropriately stretched, elongated, and deformed over a glass or plastic container opening in a direction parallel to the axis of the opening. Unlike previous packaging and sealing methods using either non-adhesive or adhesive stretch films, the present method provides a liquid-tight seal without any need to join together, overlap, press inward or otherwise secure the ends or free edges of the film. Thus, the method is unlike a pallet wrapping process and other methods for unitized wrapping of articles depending upon a cling film being wrapped or stretched around articles and anchored to itself. With pallet wrapping, attachment of the film to the underlying package is undesirable (interfering with obtaining a smooth and uniformly tensioned overwrap). However, in the present invention, it is essential that the stretch film bind in some fashion to the perimeter of a container opening. If at least one of the surfaces of the film possesses cling, the binding of the film to a glass or plastic container is improved. Applicant has found that forming a water-tight seal around a container opening with a non-adhesive wrapping film depends upon two other properties found in only certain stretch films. These properties include withstanding 200–500% film elongation without breaking or tearing, and possessing adequate elastic memory after elongation so that a noose-like self-tightening of the film occurs to establish and sustain the liquid-tight seal.

A film useful in the present invention has a polyolefin-based composition and has cling on at least one side. A rubber component may be included, e.g., an ethylene-propylene rubber. For appropriate resistance to permeation by water vapor and other gases the film has a thickness between approximately 0.5 and 5 mils (0.0005–0.005 inches). The film is substantially resistant to common organic solvents and is also resistant to temperatures of at least 100° C. Since the present film is not modified by addition of an adhesive agent to a surface of the film, it is less expensive to manufacture. In addition, the presently employed polyethylene-based film is resistant to common organic solvents, caustic acids and alkaline agents, and withstands dry heat of at least 100° C., as well as contact with boiling water.

Stretch films of this invention, being non-adhesive, can be stored in roll form without an interleaf paper, thereby reducing cost. A typical sheet of non-adhesive polyethylene stretch-wrap film used in the present invention is only about 1–1.5 mils thick (much thinner than films previously used in the method of this invention).

Thus, in a first aspect, the present invention features the laboratory use of a non-adhesive polyolefin-based elastic stretch film which is solvent resistant and heat-resistant to provide liquid-tight container closures. The term laboratory, is meant to include scientific and hospital facilities for conducting research experiments, analyses, tests, and other such technical procedures. The term liquid-tight is used to describe the ability of the stretched film to establish and maintain a non-leaking seal over an inverted standard 500 ml water-filled glass Erlenmeyer flask opening. The term elastic stretch film in the present invention is used to describe a film which tolerates a stretch-induced increase in length of at least 3-fold and preferably 6-fold without breaking and, following release of the stretch force, contracts in length at least 10% and preferably 20% in the opposite direction. In a related matter, stretch-wrapping is a process of covering and sealing an opening in a container using a stretch film having the above elastic properties. To be useful in the present invention, a polyethylene-based stretch film free of adhesive, and having an upper and lower surface must have a softening temperature in excess of 100° C., with at least one surface of the film being substantially free of constituents which can dissolve in, or react with an organic solvent or a caustic agent. The stretch wrapping method involves providing a portion of the polyethylene-based stretch film free of adhesive, of sufficient size to cover a container-opening and overhang the upper perimeter wall which defines this opening. The process further includes stretching and deforming at least one region of the film surrounding the upper perimeter wall using a mechanical force in a direction generally parallel to the principal axis of the opening to form an essentially unpleated tight outer collar around the neck or outer wall of the container, and finally releasing the force on the film allowing at least some of the stretched and deformed region of the film to contract to form a snug and essentially unpleated collar around the container's upper perimeter wall, thereby providing a liquid-tight seal over the container opening. Laboratory applications for the film include, but are not limited to the covering and sealing of laboratory devices, samples which are of animal, vegetable or mineral origin, vessels containing chemicals, and other like articles. The film has an upper and lower surface. At least one surface of the film is preferably fabricated in a manner to provide cling. The cling increases surface friction between the stretched film and the container (especially the lip of the container opening) thereby helping secure the film against slippage. The entire film is preferably free from constituents which can dissolve in or react with the following common organic solvents and caustics: ethyl ether, carbon tetrachloride, chloroform and hydrochloric acid, sulfuric acid and sodium hydroxide. One and preferably both of the film surfaces may thus be used as an effective barrier against such organic solvents and caustics. The softening temperature of the film is above 100° C., thereby allowing its use on objects exposed to boiling water.

In a second aspect, the invention features flasks, test tubes, other laboratory containers and other laboratory articles including samples of animal, vegetable or mineral materials covered with the above-described polyolefin-based stretch-wrap applied using the above-described method.

In preferred embodiments of the above aspects, the stretch film has a thickness between 0.0005 inches (0.5 mils) and 0.005 inches (5 mils), the film is a multi-layered sheet comprising at least one elastic structural layer containing a polyethylene resin such as LLDPE. The polyethylene may be blended with a rubber such as ethylenepropylene rubber (EPDM) in a ratio of between approximately 50–80% by weight polyethylene and 20–50% by weight rubber. The stretch film is constituted and configured to provide a degree of mechanical resistance to stretching compatible with and convenient for the manual stretch-wrapping of laboratory flasks, test tubes and the like. More specifically, when a stretching force of between approximately 0.5 lb. and 5 lb. is applied (at room temperature) to a one inch wide strip of the presently invented film, it commences elongation. The film is also constituted and configured to allow at least 200% and preferably 500% elongation before breakage [where % elongation equals: (final length -original length)×100÷original length], to provide a film which is useful for manual stretch wrapping of laboratory devices.

In other preferred embodiments, the non-adhesive plastic stretch wrap comprises multiple elastic structural layers. For example, the film may comprise three coextruded polyethylene-containing layers, e.g., LLDPE layers, in which one highly elastic inner core layer is symmetrically sandwiched between two outer layers. Such a symmetrically-layered structure provides strength and minimizes curling of the film following stretching. For maximizing resistance of the film to certain organic solvents such as chloroform hexane and benzene, at least one surface of the film is free from constituents which can dissolve in or react with such organic solvents or with caustic agents such as strong acids and alkalis.

Further features and advantages of the invention will become apparent from the following specification including a description of the preferred embodiments of the invention and from the claims.

DESCRIPTION OF THE PREFERRED EMBODIMENTS

Film

The films of this invention are generally described above. These films will now be described in detail and one or more specific and non-limiting examples provided.

Structure of the Film

For the purpose of this invention, the thermoplastic structure or structural layer(s) of the film is preferably transparent or semi-transparent, provide a chemically inert barrier to common organic solvents and caustic agents, and liberate no leachable or particulate contaminants when incubated in aqueous and organic solutions at room temperature. Film surfaces have been tested for solubility and reaction with various chemical agents by contacting the surfaces for 12 hours at 20° C. with each agent (held in a glass petri dish) and subsequently drying and monitoring the film for weight loss and haze formation. Results from these tests using ethanol, acetone, ethyl ether, carbon tetrachloride, chloroform, toluene, hexane, mineral oil, and strong acids and alkalis were negative. The testing sensitivity for solubility (measured by weight loss) was 0.1 mg per 100 mg of film or 0.1%. Films were also tested to withstand freezing down to −20° C. without cracking, and for possessing a softening temperature above 100° C. Films were also tested for two elastic properties including tolerating at least 200% stretch-elongation at room temperature without breaking and at least 10% elastic contraction following stretch-elongation. In general, the polyolefin thermoplastics, and in particular, certain polyethylene-based stretch films provide the appropriate chemical barrier, as well as the appropriate elastic properties and thermal resistance characteristics described above. Addition of a suitable inert rubber to polyethylenes such as LLDPE, appears to be necessary for achieving sufficient film elasticity.

EXAMPLE 1

Without being bound to any particular theory, Applicant performed the following experiments to determine a possible mechanism of action of films useful in this invention. The unusual mechanical process by which a certain type of non-adhesive polyethylene stretch film, e.g., polyethylene-based pallet wrap, can form a liquid-tight seal during stretch-deformation over a container opening was studied as follows: A square grid pattern (2 mm line spacing) was drawn onto a 150 gauge (0.0015 inch thick) rubberized polyethylene pallet wrap film known as LOADMASTER® film. This film which was obtained from the Borden Chemical Company, Resinire Division (Andover, Md.) is more fully described below. Square portions of the grid-patterned film measuring 4"×4" were hand-stretched by pulling the opposing edges of the film downward over a variety of glass and polystyrene plastic container openings having diameters ranging from approximately 0.5–2.0 inches. After the four edges of a square film had been elongated approximately 0.5–1.0 inches downward along the necks of containers (or the walls of test tubes) to form liquid-tight seals, the film samples was carefully examined. With each container, the film formed a drum-tight top surface over the container opening and an equally tight and smooth collar surface around the neck or sidewall of the container. Owing to its rubber-like elasticity, the film pulled inward to form a circumferential seal around each container's upper lip. The ability to readily form these seals was especially noted for containers fabricated from glass and certain plastics such as polystyrene and polycarbonate. It was more difficult to form similar stretch seals on polyethylene, polypropylene and stainless steel containers because a lower coefficient of friction exists between the film and these materials.

Examination of the grid pattern on the above described samples of 150 gauge LOADMASTER ® film which had been stretch-sealed by hand over a variety of container openings helped explain how sealing was achieved. Surprisingly, film stretching as evidenced by expansion and distortion of the grid pattern across the container opening, as well as in the outer perimeter area of the film was minimal. Almost all film elongation occurred immediately outside the lip or flange of the container (regardless of whether a test tube, bottle or beaker was used). In the stretch process, usually only a 2–4 mm wide ring-like region of the film surrounding the lip of each container had elongated 1–2 cm downward over the wall or neck of the container. Typically the film stretched 5–6 fold, and in all cases at least 3-fold immediately outside the container lip in the process of forming a secure liquid-tight seal. (A liquid-tight seal is defined as one formed over a 500 ml capacity glass Erleruneyer flask filled with water and withstanding any leakage when the flask is inverted.)

It was also found that if a stretch film did not either possess or retain sufficient elastic memory after stretching, the seal would rapidly loosen and fail. Accordingly, following 3–6 fold elongation (preferably 6-fold elongation), a non-adhesive stretch film useful in the present invention must be capable of contracting at least 10% in length and preferably 20%, in both the machine and transverse direction of the film.

A number of commercial non-adhesive thermoplastic barrier films have been tested for their ability to form liquid tight seals over container openings. For example, simple commercial cling films such as polyethylene and SARAN wraps (which are used in the kitchen and in the laboratory as protective films) do not readily form liquid-tight closures because of insufficient stretch and elasticity. On the other hand, the method by which self-sealing films, e.g., PARAFILM ®, and adhesive-coated films may be used to form seals on containers differs from the present invention, because these prior art films must be pressed inward and/or wrapped tightly around a container during the covering process (to adhere the film to a container and/or to itself). In the presently invented use of a polyethylene-based stretch-tolerant and elastic film, the film is appropriately elongated over a container opening and then released. The elasticity of the film causes an upward and inward noose-like contraction of the film providing a liquid-tight seal.

EXAMPLE 2

Single layer blended stretch film compositions comprising polyethylene and rubber were extruded without an adhesive to form the elastic structural layer of the present film. Film blend #1 contained approximately 75% by weight linear low density polyethylene (LLDPE) and approximately 25% by weight EPDM rubber (Polysar #306, obtained from Polysar Canada Corp.) Blend #2 contained approximately 60% by weight LLDPE and 40% by weight EPDM rubber. The resulting 2 mil thick extruded films when stretch-tested, commenced elongation with forces of 3 and 2.5 pounds respectively for 1 inch wide sample test strips of the materials. The total elongation prior to breakage was approximately 450% for blend #1 and 600% for blend #2. Elastic contraction following elongation was approximately 10–15%. One mil thick extruded films of the above blends were also formed and shown to commence elongation with about 1.5 pounds force being applied to 1 inch wide test strips. Extruded film samples were then tested for resistance to organic solvents, by incubation in the solvents overnight at 20° C. The samples were found to be resistant to all of the solvents tested including ethanol, acetone, ethyl ether, carbon tetrachloride, chloroform, toluene, hexane and mineral oil. The samples were also resistant to strong acids and alkalis including concentrated sulfuric acid, hydrochloric acid and sodium hydroxide.

EXAMPLE 3

Multi-layered industrial stretch films comprising low density polyethylene have also been used to form the foundation of the present wrap. These stretch films are manufactured for the commercial packaging industry (e.g., for pallet wrapping and food packaging applications) and are available from the Exxon Chemical Company, Dow Chemical Company and E. I. DuPont De Nemours and Company for example. A particularly useful multilayered pallet stretch wrap is available from the Borden Chemical Company, Resinire Division (Andover, Md.) and is known as LOADMASTER ® film. This film is described by the manufacturer as a slot-cast extruded LLDPE film consisting of three coextruded layers of modified LLDPE resins. The LOADMASTER ® film which was obtained in 1.0, 1.5 and 2.0 mil thicknesses and is observed to be transparent, resists tearing, exhibits good elastic memory (at least 20% contraction following stretching in both the machine and transverse direction), and tolerates a high degree of elongation before breakage (700% in the machine direction and 900% in the transverse direction). The 1.0 mil thick film possesses a resistance to stretching comparable to that of PARAFILM ®, commencing elongation when a force of approximately 600 g is applied to a one inch wide rectangular test strip of the film. A similar strip of the 5 mil thick PARAFILM ® material commences stretching when a force of 450 g is applied. Regarding temperature stability, the LOADMASTER ® film has a softening temperature of 125° C. consistent with its principal constituent, LLDPE. The chemical stability of this film is excellent. No solubility in ethanol, acetone, ethyl ether, carbon tetrachloride, toluene, hexane or mineral oil, could be detected following a two week incubation at room temperature in these solvents. Solubility was monitored as described above by testing film samples for any weight loss following solvent incubation and drying of the film samples. The film was also unreactive with strong acids and alkalis.

Method of Use of the Film

According to the present invention, certain commercial stretch wraps may be used for some of the same laboratory applications as PARAFILM ®. Thus, a stretch wrap may be used to stretch-seal test tubes, flasks, bottles, and other vessels made from glass or plastic. The vessels may contain any one of a variety of chemical materials. A rubberized polyethylene stretch film such as the LOADMASTER ® film may be used in laboratories including scientific laboratories, environmental, agricultural and industrial testing laboratories, and hospital facilities which conduct research experiments, analytical procedures, diagnostic tests and the like. The film is flexible and essentially impermeable to moisture. Thus, the film is beneficially used to reduce water loss due to evaporation from culture flasks, petri dishes and other vessels holding aqueous solutions, aqueous frozen solids, or naturally hydrated materials such as plant and animal specimens. Since one of the preferred structural materials for the stretch-film is LDPE which is impermeable to both the liquid and vapor phases of most organic solvents, the film is also beneficially used to seal vessels containing such solvents to reduce their evaporation. The film is also used as a securing and restraining film (analogous to shrink-wraps) placed over solid closures to prevent their accidental opening and reduce passage of water and chemical vapors either around or through such closures. Thus, screw-cap, snap-cap and plug-type closures are beneficially secured by the above-noted stretch wraps, for example, during sample incubation, long-term sample storage and shipping. Also, used as a total covering and enclosure sheet for glass containers and other fragile items, the present wrap is useful in reducing the frequency of breakage. In the event of container breakage, any liquid spillage and resulting damage to the surrounding materials may be reduced by the presence of this sealing film around the container.

Unlike PARAFILM ®, the film of the present invention possesses no paraffin or other cohesive or adhesive agent either in or on its surfaces. Prior to stretching the film it may weakly adhere to other objects but only by cling whose presence is useful and is preferred on at least one surface of the film. To seal a container opening, a sized portion of the film which is sufficient to cover and overhang the perimeter wall of a container opening is selected. For example, a square portion of film is taken from the roll and placed over the opening, such as a beaker, flask or test tube opening. The film perimeter which extends outward on all sides of the opening and beyond the perimeter wall of the opening is stretched downward parallel to the principal axis of the container opening using ones hands or other mechanical force means. After stretching the film approximately 0.5–1.0 inches downward on opposite sides of the opening, the force means is removed from the films.

The range of temperatures which can be tolerated by the new stretch film are much greater than with PARAFILM ®. As previously indicated, solvents such as carbon tetrachloride, chloroform, and ethyl ether (which dissolve PARAFILM ®) do not affect the polyethylene-based film. Temperatures between 60° and 100° C. (which produce failure of PARAFILM ®) are also well tolerated by the new film. Thus, stretch-film covered test tubes may now be safely incubated in a boiling water bath.

For other applications requiring visual inspection or optical measurements through a film, where the lack of transparency and substantial thickness of PARAFILM ® (5 mils) may be problematic, the presently invented films have a glass-like clarity and are only about 1 mil in thickness.

In certain working environments, the presence of an interleaf sheet (which prevents irreversible self-adhesion of PARAFILM ® during storage) is inconvenient or problematic. For example, in the darkroom environment it may be difficult to see and remove an interleaf sheet. Furthermore, when samples must be handled and sealed rapidly (for example, sequential stretch-sealing of test tube samples during the time course of an experiment), the removal of an interleaf sheet is inconvenient. Therefore the elimination of the interleaf sheet with the new stretch film is a significant improvement over PARAFILM ®.

Other embodiments are within the following claims.

I claim:

1. A method for covering and sealing an opening in a laboratory container, said opening defined by an upper perimeter wall, said method employing a sized portion of a polyolefin-based stretch film free of adhesive, said film having an upper and lower surface and a softening temperature in excess of 100° C., wherein at least one surface of said film is substantially free of constituents which can dissolve in, or react with a organic solvent or a caustic agent, said method comprising the steps of:

providing a portion of said film sufficient in size to cover said opening and overhang said perimeter wall, stretching and deforming at least one region of said film surrounding said upper perimeter wall using a mechanical force in a direction generally parallel to the principal axis of said opening, releasing said force and allowing at least some of said region of said film to contract to form a snug and essentially unpleated collar around said perimeter wall, thereby providing a liquid-tight seal over said container opening.

2. The method of claim 1, wherein said stretching step comprises stretching said region of said film to at least three times its original length.

3. The method of claim 1, wherein said releasing step comprises allowing at least some of said stretched region of said film to contract at least ten percent in length.

4. The method of claim 1, wherein said polyolefin-based stretch film comprises linear low density polyethylene.

5. The method of claim 1, wherein said polyolefin-based stretch film comprises a rubber component.

6. The method of claim 5, wherein the rubber component comprises ethylene-propylene rubber.

7. The method of claim 1, wherein said stretch film has a thickness of between 0.0005 inches and 0.005 inches.

8. The method of claim 1, wherein a one-inch wide strip of said film is caused to elongate when a stretching force of at least 0.5 lb. is applied to said film.

9. The method of claim 1 wherein prior to said stretching and deforming step said film is placed on said container so as to overhand said upper perimeter wall, and wherein said stretching and deforming step comprises stretching and deforming opposing sides of said film outside said perimeter wall using manual force on the opposing edges of said film in a direction generally parallel to the principal axis of said opening, said stretching and deforming being accomplished in the absence of any mechanical device.

10. The method of claim 1 wherein said stretch film is able to withstand 200 to 500% elongation without breaking or tearing and possesses elastic memory after elongation so that a noose-like self-tightening of the film occurs around said container opening.

11. The method of claim 10 wherein said elastic memory causes said stretch film to contract in length at least 10% after stretching.

12. The method of claim 1 wherein said container is a laboratory container comprising a laboratory chemical.

* * * * *